US006131658A

United States Patent [19]

Minear

[11] Patent Number: 6,131,658

[45] Date of Patent: Oct. 17, 2000

[54] METHOD FOR PERMANENT EMPLACEMENT OF SENSORS INSIDE CASING

[75] Inventor: John W. Minear, Houston, Tex.

[73] Assignee: Halliburton Energy Services, Inc., Houston, Tex.

[21] Appl. No.: 09/260,746

[22] Filed: Mar. 1, 1999

Related U.S. Application Data

[60] Provisional application No. 60/078,168, Mar. 16, 1998.

[51] Int. Cl.[7] ..... E21B 47/00

[52] U.S. Cl. ..... 166/250.01; 166/66; 166/254.1; 175/50; 367/82

[58] Field of Search ..... 175/40, 50; 166/64, 166/65.1, 66, 250.01, 250.07, 250.15, 254.1; 324/207.13–207.17; 367/82, 117

[56] References Cited

U.S. PATENT DOCUMENTS

| | | | |
|---|---|---|---|
| 4,597,067 | 6/1986 | Bockhorst et al. | 175/40 X |
| 4,775,009 | 10/1988 | Wittrisch et al. . | |
| 4,986,350 | 1/1991 | Czernichow | 166/65.1 |
| 5,061,823 | 10/1991 | Carroll | 174/105 R |
| 5,210,490 | 5/1993 | Munch et al. | 324/207.17 |
| 5,467,823 | 11/1995 | Babour et al. | 166/250.01 |
| 5,607,015 | 3/1997 | Bergren et al. | 166/250.01 |
| 5,642,051 | 6/1997 | Babour et al. | 324/357 |
| 6,026,911 | 2/2000 | Angle et al. | 175/24 |

FOREIGN PATENT DOCUMENTS

| | | |
|---|---|---|
| 0547961 | 6/1993 | European Pat. Off. . |
| 2229001 | 9/1990 | United Kingdom . |
| 2307077 | 5/1997 | United Kingdom . |

OTHER PUBLICATIONS

*Field Measurements of Annular Pressure and Temperature During Primary Cementing*, Aug. 1983.

*Uniwell Borehole Seismic Project*, Edinburgh UNIWELL Project Scope, Feb. 21, 1997.

*Permanent Downhole Gauges: A Key To Optimize Deepsea Production*, Copyright 1992, Offshore Technology Conference.

*The Steepbank crosswell seismic project: Reservoir definition and evaluation of steamflood technology in Alberta tar sands*, The Leading Edge, Jul. 1994.

*Retrievable 1/2–inch OD borehole seismic package*, James N. Albright et al. (no date).

*Experience With Permanent Bottomhole Pressure/Temperature Gauges in a North Sea Oil Field*, SPE Production Engineering, Nov. 1988.

*Primary Examiner*—Roger Schoeppel

*Attorney, Agent, or Firm*—Conley, Rose & Tayon, P.C.

[57] ABSTRACT

An array of sensors is disposed on an umbilical cable attached to tubing extending into a well. The sensor array includes a series of evenly spaced three-component accelerometers individually mounted on biasing members, such as bowspring centralizer fins, which clamp the accelerometers to an outer casing to establish a mechanical coupling between the accelerometers and the surrounding formation. The accelerometers are lightweight such that the biasing members provide sufficient clamping force to ensure mechanical coupling, thereby facilitating the emplacement of the sensor array. The umbilical cable coupling the accelerometers and extending to the surface may include a crush resistant metal coil wrapped around an inner transmission cable which carries power and/or telemetry information from downhole to the surface. The metal coil provides a higher crush resistance and a higher flexibility than comparable solid metal tubing. A wire wrap similar to that used for wireline cables may be provided outside the metal coil for added tensile strength, and an abrasion-resistant plastic coating may also be employed to enhance the longevity of the umbilical cable.

25 Claims, 9 Drawing Sheets

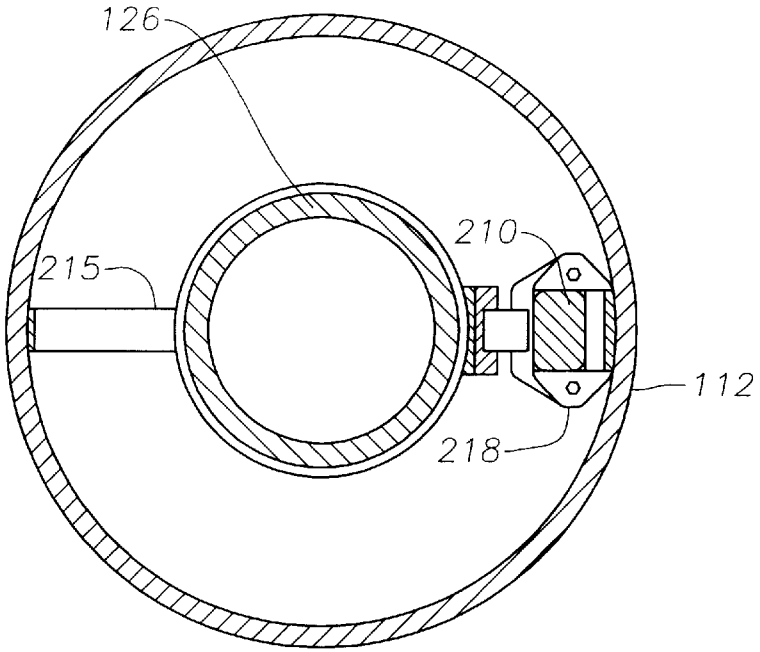
Fig. 2B
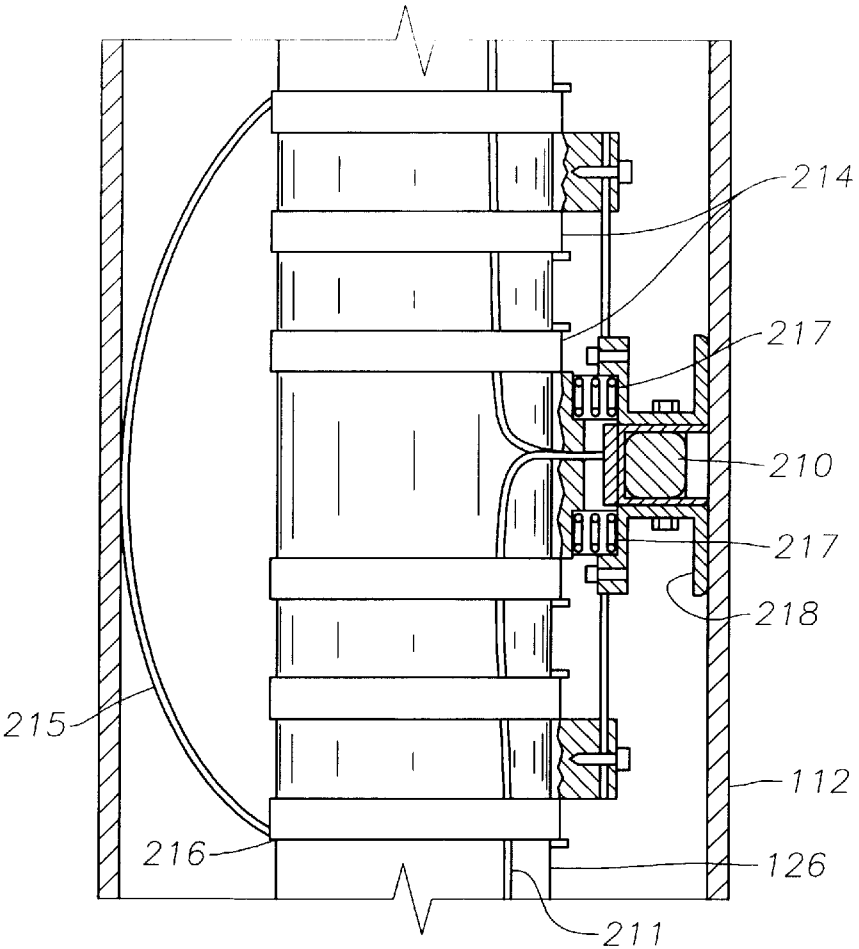

Fig. 10A Crush Tests
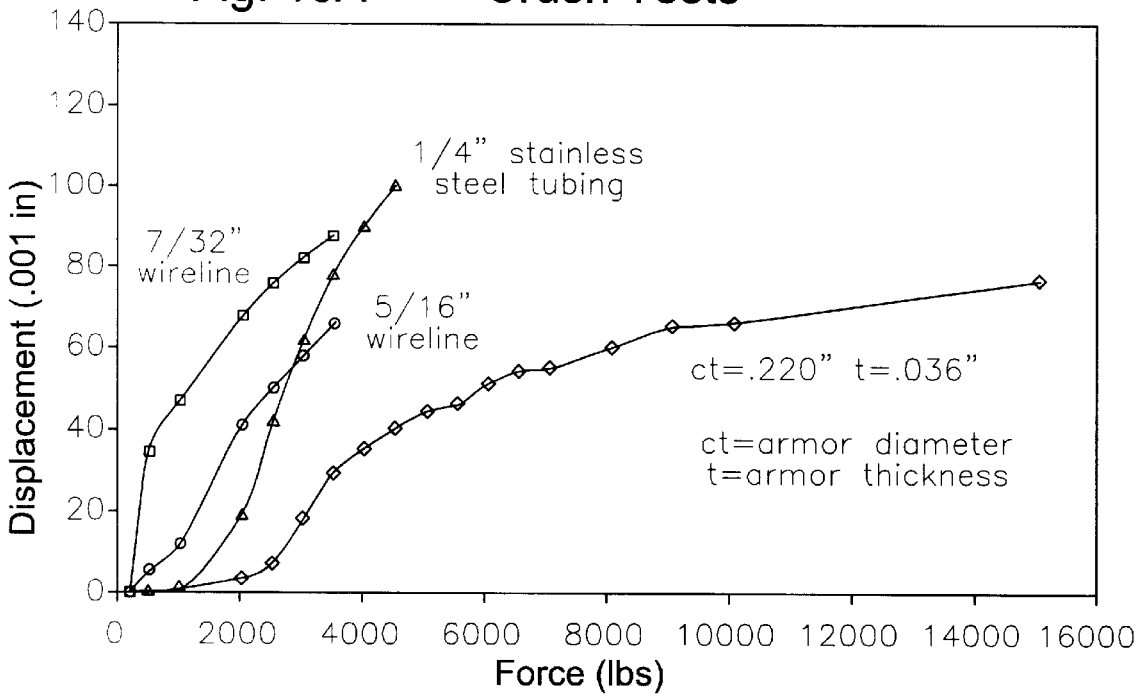
Fig. 10B
Crush Tests
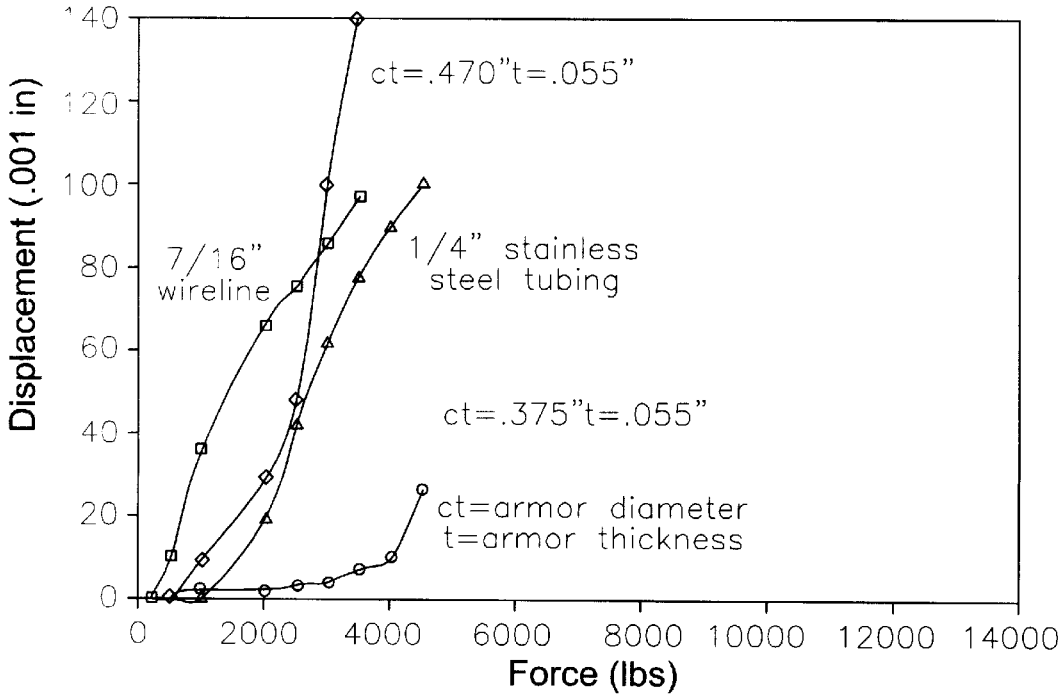

METHOD FOR PERMANENT EMPLACEMENT OF SENSORS INSIDE CASING

CROSS-REFERENCE TO RELATED APPLICATION

The present application claims the benefit of 35 U.S.C. 111(b) provisional application Ser. No. 60/078,168 filed Mar. 16, 1998 and entitled Crush Resistant Umbilical Cable for Long Term Monitoring Sensors.

BACKGROUND OF THE INVENTION

1. Field of the Invention

This invention generally relates to a method and apparatus for receiving and monitoring various signals (e.g. seismic, pressure, and temperature signals) in a borehole and more particularly to a process for installing an array of sensors inside a well in order to carry out extremely diverse measurements concerning the state of the well, to monitor flows inside the well, and to determine the evolution of the reservoir over time.

2. Description of the Related Art

During the production of hydrocarbons from an underground reservoir or formation, it is important to determine the development and behavior of the reservoir and to foresee changes which will affect the reservoir. Methods and apparatus for determining and measuring downhole parameters for forecasting the behavior of the reservoir are well known in the art.

A typical method and apparatus includes placing one or more sensors downhole adjacent the reservoir and recording seismic signals generated from a source often located at the surface. Hydrophones, geophones, and accelerometers are three typical types of sensors used for recording such seismic signals. Hydrophones respond to pressure changes in a fluid excited by seismic waves, and consequently must be in contact with the fluid to fimction. Hydrophones are non-directional and respond only to the compressional component of the seismic wave. They can be used to indirectly measure the shear wave component when the shear component is converted to a compressional wave (e.g. at formation interfaces or at the wellbore-formation interface). Geophones measure both compressional and shear waves directly They include particle velocity detectors and typically provide three-component velocity measurement. Accelerometers also directly measure both compressional and shear waves directly, but instead of detecting particle velocities, accelerometers detect accelerations, and hence have higher sensitivities at higher frequencies. Accelerometers are available having three-component acceleration measurements. Both geophones and accelerometers can be used to determine the direction of arrival of the incident elastic wave. One method which has been used to accomplish well logging or vertical seismic profiling is attaching the sensor to a wireline sonde and then lowering the wireline sonde into the bore of the well. See for example UK Patent Application GB 2,229,001A and "Permanent Seismic Monitoring, A System for Microseismology Studies" by Createch Industrie France, both incorporated herein by reference. U.S. Pat. No. 5,607,015, incorporated herein by reference, discloses installing an array of sensors suspended on a wireline into the well.

Wireline sondes contain a large number of various sensors enabling various parameters to be measured, especially acoustic noise, natural radioactivity, temperature, pressure, etc. The sensors may be positioned inside the production tubing for carrying out localized measurements of the nearby annulus or for monitoring fluid flowing through the production tubing.

In the case of geophones and accelerometers, the sensors must be mechanically coupled to the formation in order to make the desired measurement. UK Patent Application GB 2,307,077A, incorporated herein by reference, discloses providing the wireline sonde with an arm which can be extended against the wall of the casing. When extended, the arm presses ("clamps") the sensor against the opposite wall of the casing with a clamping force sufficient to prevent relative motion of the sensor with respect to the casing. As a rule of thumb, the clamping force should be at least five times the weight of the sensor, and it is not uncommon for sensors to weigh 30 lbs. or more.

Another method includes attaching sensors to the exterior of the casing as it is installed in the well. The annulus around the casing is then cemented such that when the cement sets, the sensors are permanently and mechanically coupled to the casing and formation by the cement. See for example U.S. Pat. Nos. 4,775,009 and 5,467,823 and EP 0 547 961 A1, all incorporated herein by reference.

One proposed use for sensor arrays includes the real-time monitoring of a fracture as it is being formed in a formation. These systems use arrays of acoustical energy sensors (e.g. geophones, hydrophones, etc.) which are located in a well that is in acoustical communication with the formation to detect the sequence of seismic events (e.g. shocks or "mini earthquakes") which occur as the formation is being hydraulically fractured. The sensors convert this acoustic energy to signals which are transmitted to the surface for processing to thereby develop the profile of the fracture as it is being formed in the formation. This monitoring is particularly useful when the hydraulic fracturing is performed for disposing waste materials in subterranean formations. Certain waste materials may be injected as a slurry into earth formations: e.g. see U.S. Pat. Nos. 4,942,929 and 5,387,737. The sensor arrays are then used to ensure the fracture (and hence the waste material) does not encroach into neighboring formations.

Well logging, whether from wireline or drill stem, only provides a very limited amount of information about the hydrocarbon reservoir. Monitoring and understanding formation subsidence and fluid movement in the interwell spacing is critical to improving the volume of hydrocarbons recovered from the reservoir and the efficiency with which they are recovered. One method for monitoring is time lapse seismic monitoring.

Subsidence of the strata within and above a reservoir may take place during hydrocarbon production because of movement and withdrawal of fluids. This subsidence and pore pressure changes caused by movement of fluids may cause tiny earthquakes. These "micro-earthquakes" may be detected by very sensitive seismic sensors placed in the wellbore near the microearthquake activity. Continuous seismic monitoring of such detected activity offers the possibility of monitoring subsidence and fluid migration patterns in reservoirs. Reservoirs are complicated and knowledge is needed to predict their flow paths and barriers.

Most of the cost of 3-D surveys is in data acquisition which is currently being done with temporary arrays of surface sources and receivers. Long-term emplacement of the receivers has the potential of lowering significantly data acquisition costs. There are two important reasons for long-term emplacement of receivers, first, repeatability is improved and second, by positioning the receivers closer to the reservoir, noise is reduced and vertical resolution of the seismic information is improved. Further, from an operational standpoint, it is preferred that receivers be placed in the field early to provide the capability of repeating 3-D surveys at time intervals more dependent on reservoir management requirements than on data acquisition constraints.

One method to determine the time evolution of a reservoir under production is the three dimensional vertical seismic profile (VSP). This method comprises the reception of waves returned by various underground reflectors by means of an array of geophones arranged at various depths inside the well, these waves having been transmitted by a seismic generator disposed on the surface or possibly inside another well. By obtaining a sequence of records distributed over a period of six months to many (e.g. ten) years, it becomes possible to monitor the movement of fluid in the reservoirs, and to thereby obtain information needed to improve the volume of recovered hydrocarbons and the efficiency with which they are recovered.

Long-term borehole sensor arrays for seismic monitoring must consist of many levels of sensors in order to provide sufficient reservoir coverage. Monitoring a reservoir with long-term seismic sensors requires many more sensors than those being used merely to monitor pressure and temperature in a wellbore. Pressure and temperature monitoring typically consists of a single sensor level near the producing zone.

Further, the general approach used for deploying arrays of downhole geophones has been to adapt surface seismic data acquisition cables to the downhole applications. Typically the downhole installations have used conventional geophones packaged in some hardened module with each geophone connected to the surface with a twisted pair of copper wires. Analog telemetry over twisted-pair copper wire has major disadvantages for large numbers of sensors. A large diameter umbilical cable is necessary because of the individual wires required for each sensor. Since molded connectors tend to be the main failure points, increasing the number of sensors also increases the number of connectors and increases the probability of failure in the sensor array. Further only low telemetry rates can be achieved. Seismic data for 3-D monitoring of reservoirs is vastly larger in quantity than for pressure and temperature monitoring. Further, storing any significant amount of data downhole is not practical. The data must be transmitted real time.

One deficiency of the prior art is protecting the umbilical cable from damage during emplacement. As arrays of sensors strapped to the outside of a string of pipe pass the bends and turns in the outer casing, they are subjected to shear and compression forces. These have caused many sensors and umbilical cables to be damaged or broken.

The present invention overcomes these deficiencies of the prior art.

SUMMARY OF THE INVENTION

The apparatus of the present invention includes an array of sensors disposed on an umbilical cable attached to tubing extending into a well. In one embodiment, the sensor array includes a series of evenly spaced three-component accelerometers individually mounted on biasing members, such as bowspring centralizer fins, which clamp the accelerometers to an outer casing to establish a mechanical coupling between the accelerometers and the surrounding formation. The accelerometers are lightweight so that the biasing members provide sufficient clamping force to ensure mechanical coupling, thereby facilitating the emplacement of the sensor array. The umbilical cable coupling the accelerometers and extending to the surface may include a crush resistant metal coil wrapped around an inner transmission cable which carries power and/or telemetry information from downhole to the surface. The metal coil provides a crush resistance comparable to solid metal tubing with a much higher flexibility. A standard wireline wrap may be provided outside the metal coil for added tensile strength, and an abrasion-resistant plastic coating may also be employed to enhance the durability of the umbilical cable during emplacement.

Other objects and advantages of the invention will become apparent upon reading the following detailed description and upon reference to the accompanying drawings.

BRIEF DESCRIPTION OF THE DRAWINGS

For a detailed description of a preferred embodiment of the invention, reference will now be made to the accompanying drawings wherein:

FIG. 2B illustrates a novel biasing element for establishing mechanical coupling between a sensor and a surrounding mechanical formation;

FIGS. 10A and 10B show crush resistance test results; and

Figure 1:
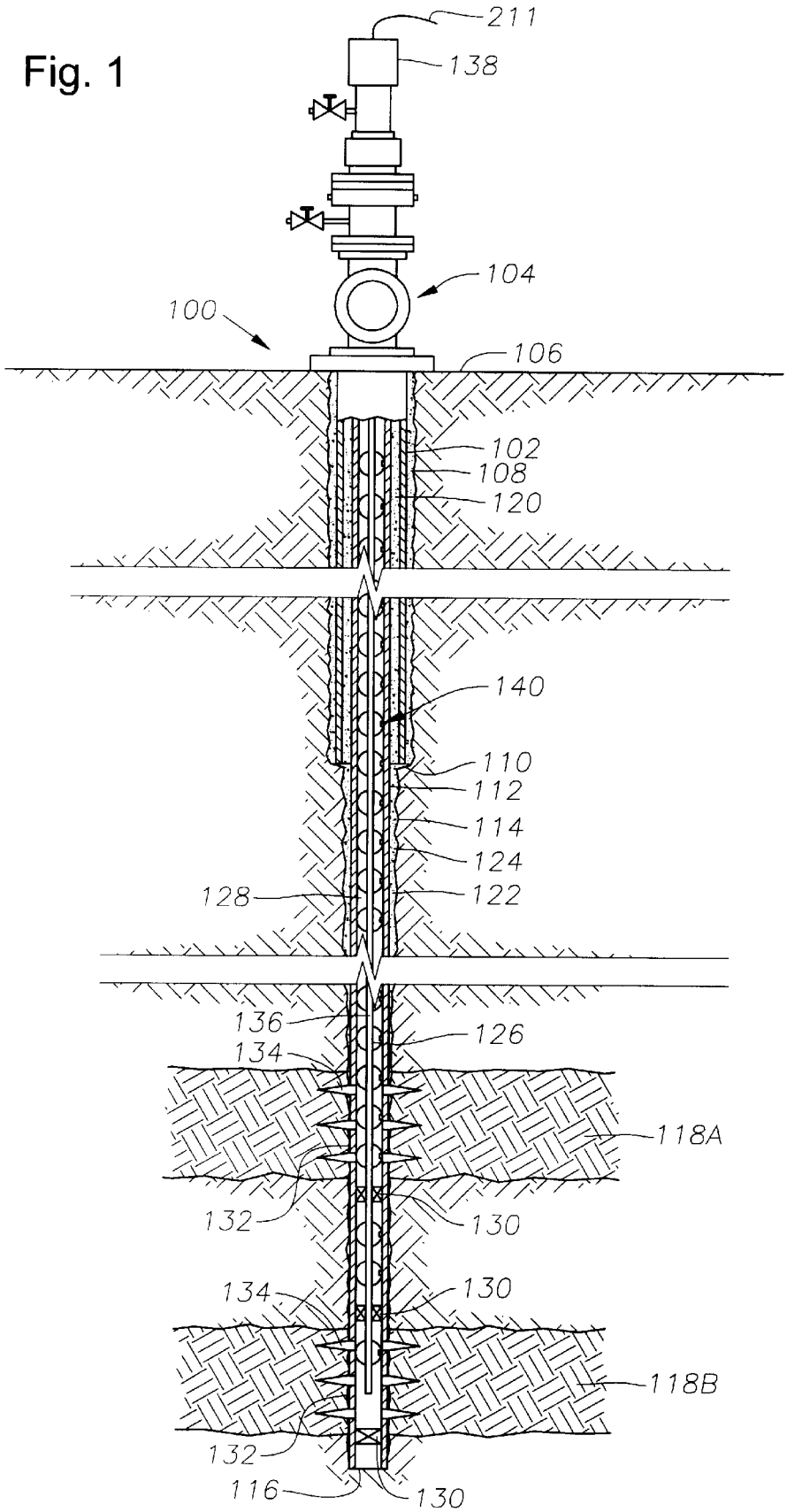
FIG. 1 is a simplified schematic of a well.

While the invention is susceptible to various modifications and alternative forms, specific embodiments thereof are shown by way of example in the drawings and will herein be described in detail. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

DETAILED DESCRIPTION OF THE PREFERRED EMBODIMENTS

Referring initially to FIG. 1, there is shown a simplified depiction of a well 100. Well 100 has an outer casing 102 extending from a wellhead 104 at the surface 106 through a large diameter borehole 108 to a certain depth 110. Outer casing 102 is cemented within borehole 108. An inner casing 112 is supported at wellhead 104 and extends through outer casing 102 and a smaller diameter borehole 114 to the bottom 116 of the well 100. Inner casing 112 passes through one or more production zones 118A, 118B. Inner casing 112 forms an annulus 120 with outer casing 102 and an annulus 122 with borehole 114. Annulus 120 and annulus 122 are filled with cement 124. A production tubing 126 is then supported at wellhead 104 and extends down the bore 128 of inner casing 112. The lower end of tubing 126 is packed with a packer 130 above the lowest of the production zones 118B. Other packers 130 may be provided to further define other production zones 118A, and to seal off the bottom of the well 116. The lower portion 132 of inner casing 112 is perforated at 134 to allow hydrocarbons to flow into inner casing 112. The hydrocarbons from the lowest production zone 118B flow up the flow bore 136 of production tubing 126 to the wellhead 104 at the surface 106, while the hydrocarbons from the other production zone 118A may be comingled with the flow from zone 118B or may flow up the annulus between inner casing 112 and tubing 126. A christmas tree 138 is disposed on wellhead 104 fitted with valves to control flow through tubing 126 and the annulus around tubing 126.

Figure 2A:
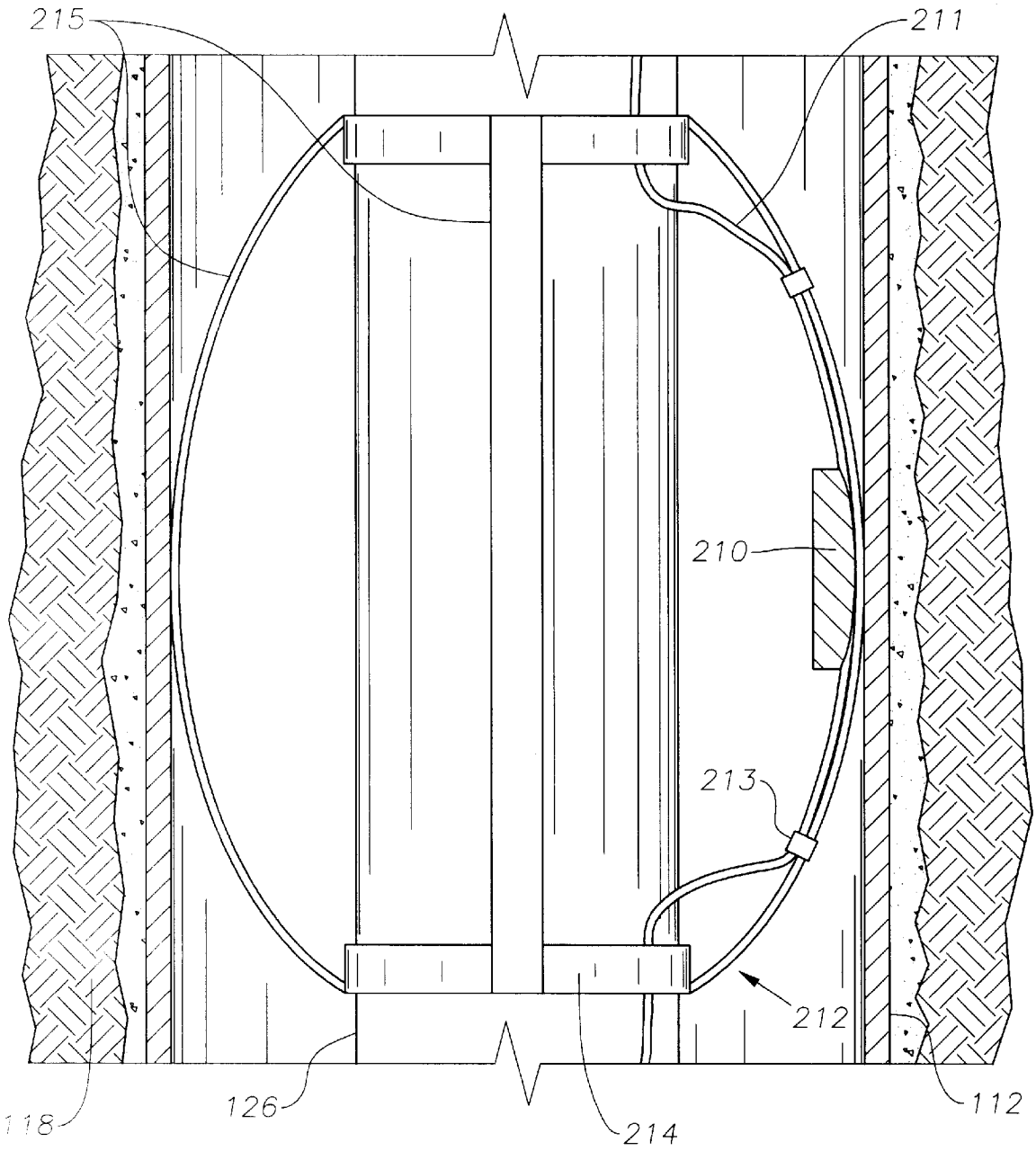
FIG. 2A illustrates a bowspring biasing element adapted to establish mechanical coupling between a sensor and the surrounding formation.

Referring now to FIGS. 1 and 2A, an array 140 of long-term sensors 210, disposed on an umbilical cable 211, are preferably disposed on production tubing 126 as tubing 126 is assembled and lowered into the bore 128 of inner casing 112. The sensors 210 are preferably attached to the outside of the tubing 126 at specified depth intervals and may extend from the lower end of tubing 126 to the surface 106. The necessary mechanical coupling between the sensors and inner casing 112 is provided by biasing elements 212. It should be appreciated that although the array 140 is shown disposed on tubing 126, array 140 may also be disposed on inner casing 112. To facilitate installing the large number of sensors 210 (possibly up to several hundred) on the tubing 126 as it is lowered into the bore 128, a configuration such as that shown in FIG. 2A may be employed.

FIG. 2A shows biasing elements 212 of a known type fixed upon tubing 126 for facilitating its descent into the well 100. The biasing elements 212 may be equipped with any flexible or extensible radial member for locating tubing 126 at a desired location within bore 128 of inner casing 112. In the preferred embodiment, the biasing element 212 includes a plurality of flexible or extensible blades 215 and a plurality of clamps 214 for mounting the biasing element 212. The sensor 210 is placed on one of the blades 215 of biasing element 212, and a mechanical contact thereby established between sensor 210 and the hydrocarbon formation 118. The umbilical cable 211 coupling the sensor 210 to the surface 106 may be clamped to the outer surface of tubing 126 by plastic ties or metal straps 213.

Sensors 210 are preferably lightweight sensors weighing less than a pound whereby the requisite clamping force is more easily supplied. Blades 215 are preferably bowsprings which provide a clamping force which is at least five times greater than the weight of the sensors 210. Accelerometers can be manufactured in very small lightweight packages (less than a pound in a volume of several cubic centimeters) using micro-machining techniques, in which silicon is etched to form a cantilever beam and electronic position sensors of the beam. Such sensors are available from companies such as OYO, Mark Products, and Input/Output Inc. Mark Products has developed a ½" outside diameter downhole retrievable geophone package using geophones that are 0.3 inches in diameter.

FIG. 2B shows an alternate biasing element configuration 216 which may be used for establishing a mechanical contact between sensor 210 and the hydrocarbon formation 118. A slider 218 is mounted on springs 217, which in turn are mounted on tubing 126 by clamps 214. The slider 218 is held against the inner casing 112 by a bow spring 215 which exerts a force on the inner casing 112 opposite the slider 218. The sensor 210 is mounted on slider 218.

Figure 4:
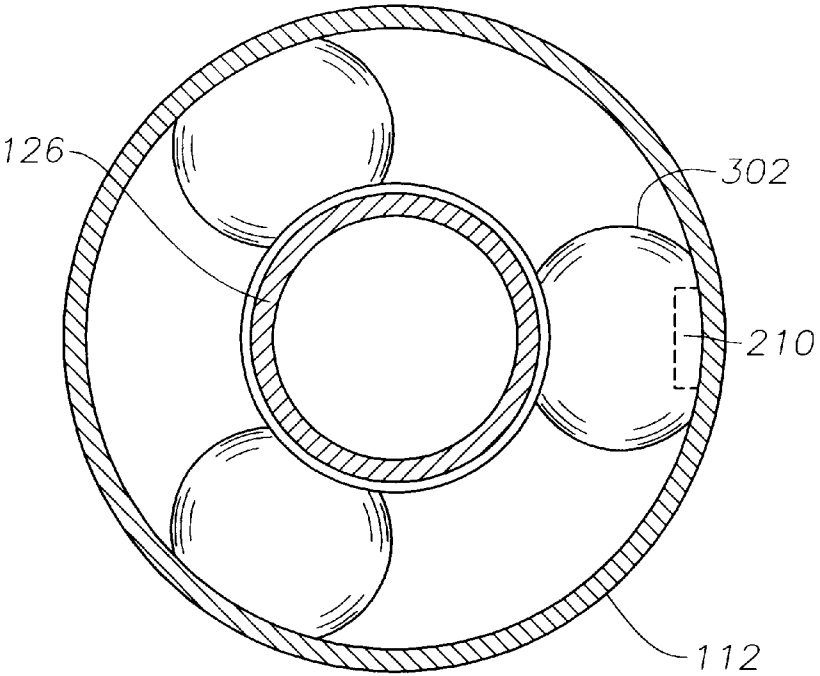
FIG. 4 illustrates an overhead view of the bladder element.
Figure 3:
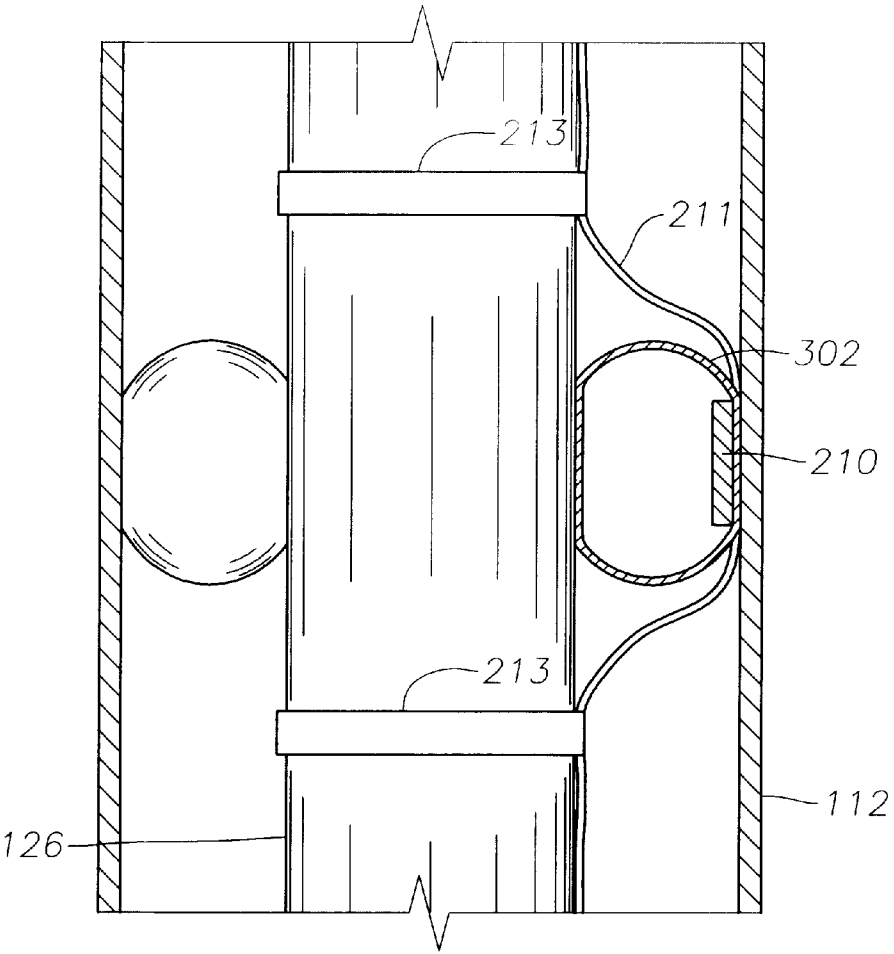
FIG. 3 illustrates a bladder element adapted to establish mechanical coupling between a sensor and the casing.

Referring now to FIGS. 3 and 4, other coupling methods may also be used. For example, the sensors may be attached to the interior of inflatable bladders 302. After the tubing 126 has been inserted, the bladders 302 may be inflated with gas or fluid by various means including, but not limited to, unidirectional check valves, induced chemical reactions, and electrical pumps. Preferably, a deflation means is also provided in the event that it is desired to remove the tubing 126 from the well. Various deflation means are contemplated, including a locking check valve which locks into an open position when a predetermined pressure is applied to it. In any case, whichever coupling method is used, design considerations may be made to ensure that the clamping means does not resonate in the frequency range of interest.

Although the mechanical coupling between the sensors and the formation has been discussed using biasing elements which generally center the tubing within the wellbore , it is recognized that other biasing elements which induce eccentricity can be used. In view of the small clamping forces required, a single fin or extensible arm may be sufficient to establish mechanical coupling.

It is noted that these coupling methods may be used for sensors other than just geophones and accelerometers. For example, these coupling methods may be used for acoustic or electromagnetic sensors for communicating with measurement sensors installed outside the casing 112.

Figure 5:
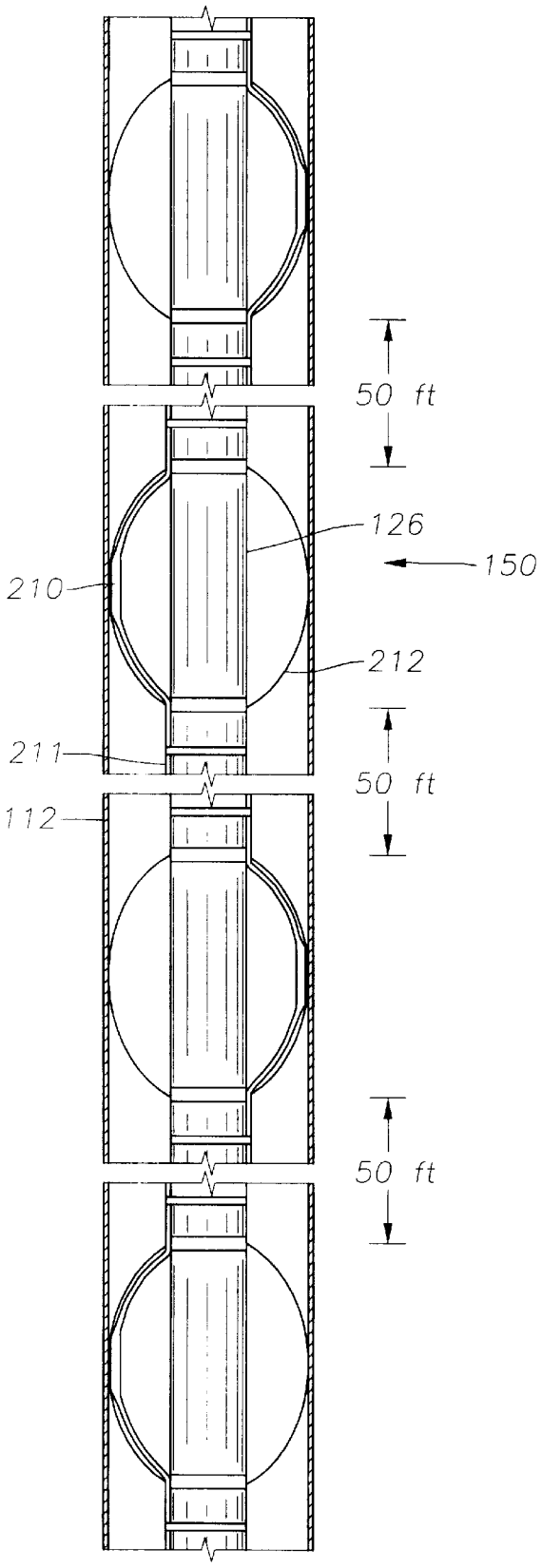
FIG. 5 illustrates one embodiment of a sensor array.

Referring now to FIG. 5, there is shown an array 150 of sensors 210 which are integrated into an umbilical cable 211 which is attached to the outside of tubing 126. Sensors 210 are located inside biasing elements 212 or bladders 302 shown in FIGS. 3 and 4 which establish mechanical coupling by pressing against the casing 112. The umbilical cable 211 incorporates protection from mechanical crushing, pressure, and corrosive fluids. By integrating the sensors 210 into the cable 211, the need for complex sealed connectors is avoided.

A major problem in placing the arrays 140, 150 of sensors 210 is in protecting the sensors 210 and the telemetry path from damage during the emplacement operation. The umbilical cable 211 must withstand abrasion and crushing as the pipe is passed downwardly through the casing 112.

Existing logging cables (aka wirelines) consist of wire rope wound around an inner core containing copper wires and/or optical fibers. The wire rope is for protection and to provide a high tensile strength for supporting logging tools in the wellbore. However, these cables have relatively small crush resistances. Another approach which has been used is to install the sensor arrays inside small diameter steel tubing.

Figure 6:
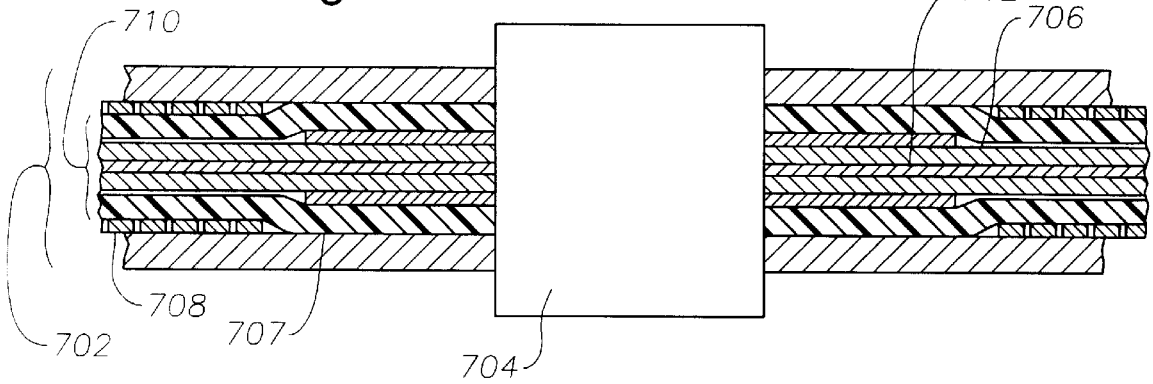
FIG. 6 illustrates one embodiment of a crush resistant cable.

Referring now to FIG. 6, there is shown an umbilical cable 702 coupled to a sensor package 704. To provide umbilical cable 702 with improved crush resistance while allowing flexibility, a metal coil of round or flattened wire 708 is wrapped around an inner umbilical 710 having a core sheath 706 and one or more conduits 712. Examples of conduits include electrical conductors (such as pairs of copper wire or coaxial cable) and optical fibers. Preferably the metal coil 708 is separated from the inner umbilical 710 by an abrasion resistant plastic sheath 707. Also, the metal coil 708 is preferably wrapped compressing inner umbilical 710 to prevent slippage between inner umbilical 710 and metal coil 708. The short or "tight" lay of the metal coil 708 provides the crush resistance. The crush resistance provided by this coil 708 may be made comparable to that of a solid tube, and early tests indicate that a higher crush resistance may be achieved by the coil 708.

FIGS. 10A and 10B show the force required to crush an armored cable by a given amount. Plots are shown in FIG. 10A for a standard 7/32" and 5/16" outer diameter wireline cables, a cable armored with standard ¼" outer diameter (0.15" inner diameter) stainless steel tubing, and a cable armored with an 0.292" outer diameter (0.22" inner diameter) stainless steel coil. The crush resistance of the coiled armor configuration compares very favorably to the other armored cable configurations shown.

FIG. 10B includes plots for a standard 7/16" outer diameter wireline cable, the ¼" stainless steel tubing armored cable, a cable armored with 0.470" outer diameter (0.415" inner diameter) stainless steel coil, and a cable armored with 0.375" outer diameter (0.320" inner diameter) stainless steel coil. The 0.470" coiled armor cable has a crush resistance comparable to the ¼" solid tubing armor, yet it has an inner diameter nearly three times that of the solid tubing armor. The 0.375" coiled armor cable has a crush resistance that also compares very favorably to the other armored configurations shown.

In a preferred embodiment, the metal coil 708 is made up of a single flattened stainless steel wire 714 having a rectangular cross-section, with the width (parallel to the cable axis) of the wire 714 between 1.5 and 3.5 times the thickness (perpendicular to the cable axis) of the wire 714. For maximum crush resistance, no space is left at 718 between adjacent windings of the wire 714.

The exterior of the umbilical cables 211 may be coated with abrasion-resistant plastic. An example of would be TefSel, a Teflon®-based material which has desirable high-temperature properties.

Figure 7A:
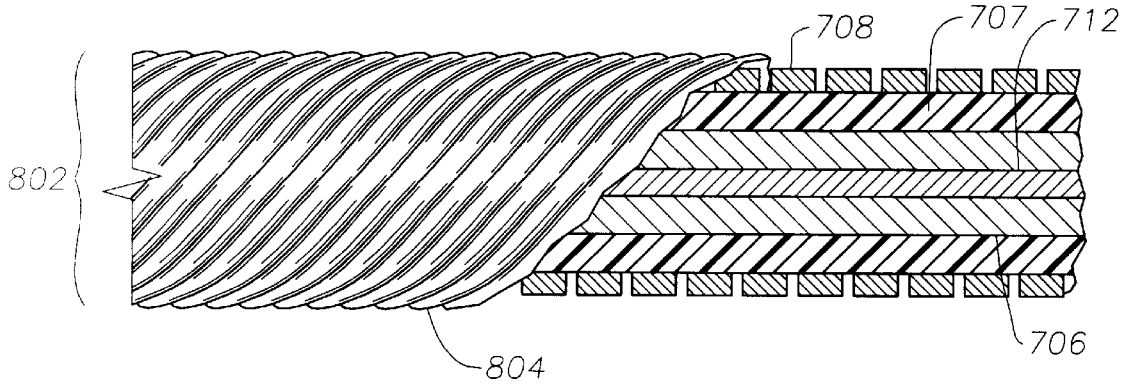
FIG. 7A illustrates a second embodiment of a crush resistant cable.

Referring now to FIG. 7A, there is shown a crush resistant umbilical cable 802. To provide the crush resistant cable 802 with additional tensile strength, a wire wrap similar to that used for standard wireline cables 804 is placed over the metal coil 708. The long lay of the wireline wrap 804 allows it to carry the burden of umbilical cable 802. The preferred embodiment of cable 802 comprises a four-layer wireline wrap, but it is understood that many variations exist and may be employed.

Figure 7B:
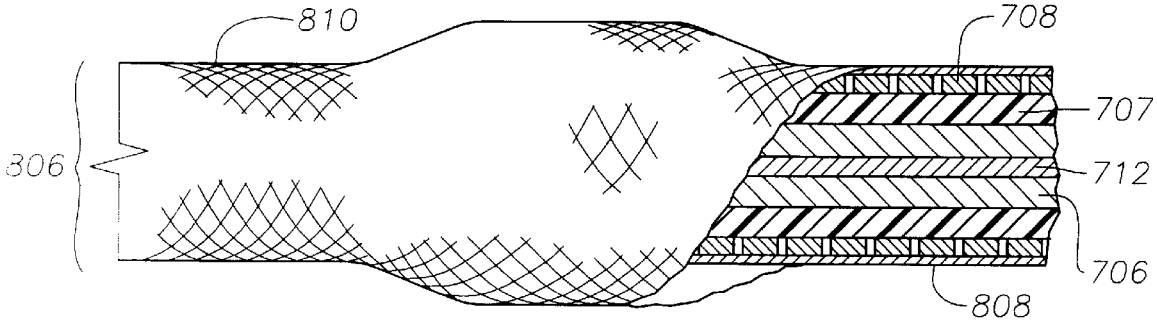
FIG. 7B illustrates a third embodiment of a crush resistant cable.

FIG. 7B shows another crush resistant cable embodiment 806. Cable 806 includes a protective layer 808 over the metal coil 708, and a woven wire braid 810 over the protective layer. The long lay of the woven wire braid 810 provides tensile strength to cable 806. It is contemplated that the woven wire braid 810 may be wrapped around the sensor 704 so that the sensors become incorporated into a continuous umbilical cable 211. The sensors 210 would then just appear as "lumps" in the umbilical cable 211. This would provide extra protection to the couplings between the inner umbilical 710 and the sensor package 704 which are often the weak point in the sensor array. In one contemplated embodiment, the umbilical cable 211 incorporates 200 three-component accelerometers spaced fifty feet apart. Each accelerometer performs 16-bit sampling at 4000 samples per second per component. Optical fibers (or copper wire) 712 carry the resulting 38.4 Mbit/sec of telemetry data to the surface 106. Power conductors (not shown) may be included in the umbilical cable 211 to provide power to the accelerometers 210.

Alternatively, power and data telemetry may be simultaneously accommodated over the inner conductor of a coaxial cable.

Figure 8:
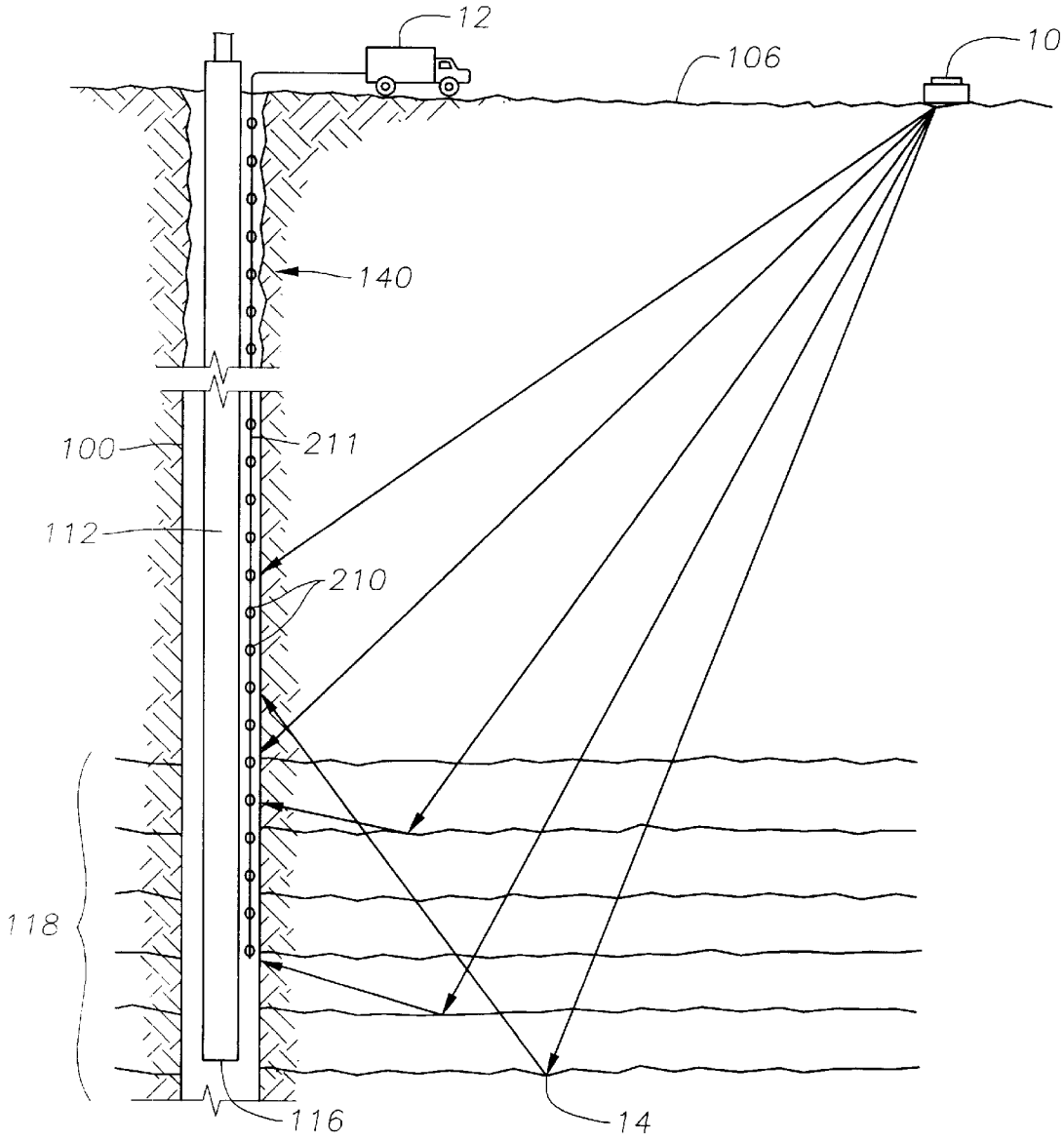
FIG. 8 illustrates a vertical seismic profiling process.

Referring now to FIG. 8, there is illustrated a process for vertical seismic profiling of the formation 118 in well 100. A seismic source 10 (a vibrator or pulse source) generates seismic waves on the surface 106, and these waves propagate through the ground, spreading out as they move deeper and reflecting off of underground reflectors 14. The waves sent back by the various underground reflectors 14, and in particular those of the production zone 118, are received by the array 140 of sensors 210 coupled to tubing 126 and extending from the bottom 116 of the well 100 to the surface 106. The sensors 210 transmit detected signals via the umbilical cable 211 to a recording laboratory 12.

Figure 9:
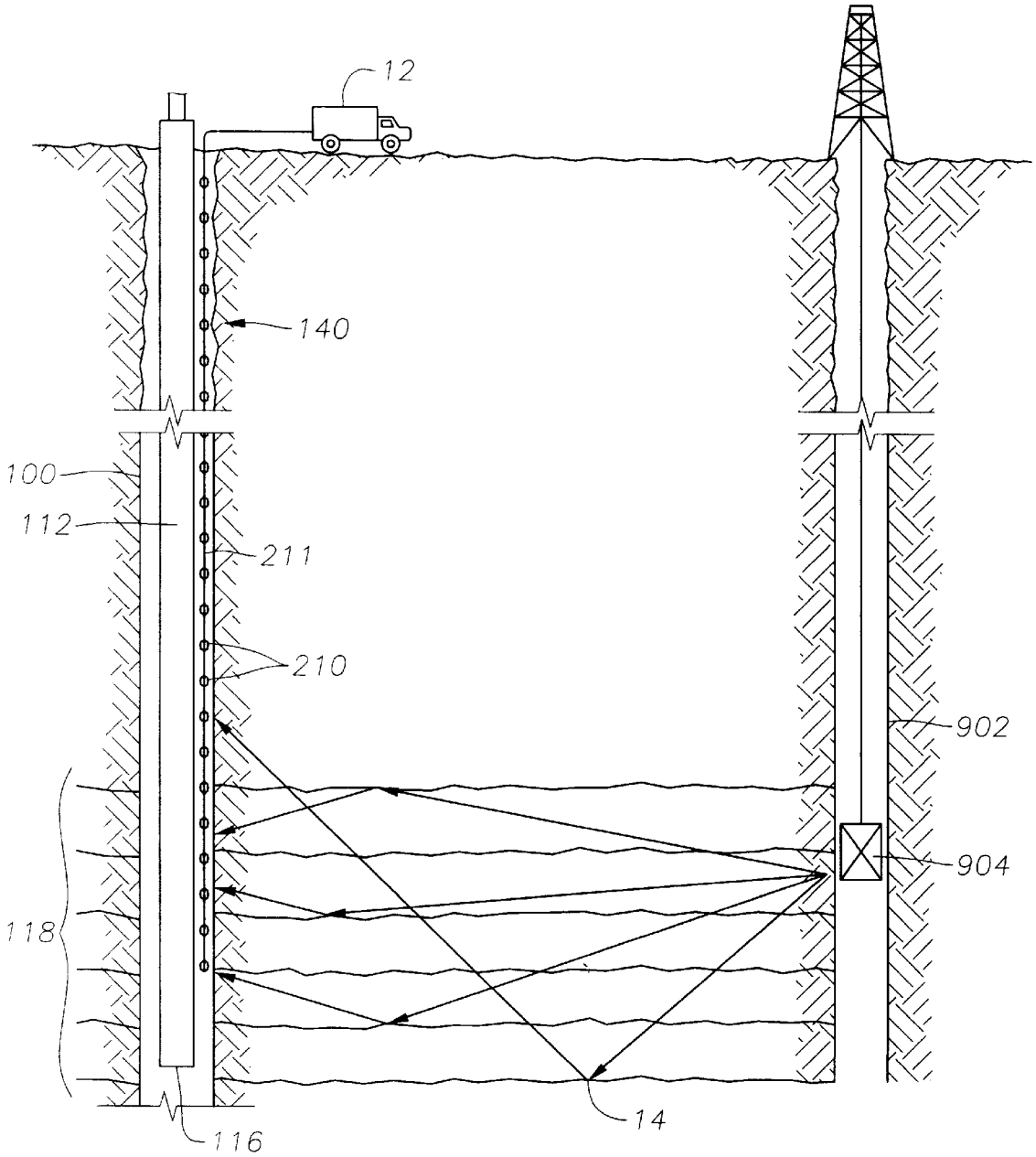
FIG. 9 illustrates a cross-well seismic profiling process.

The source 10 of the detected signals is not necessarily on the surface 106. For example, FIG. 9 illustrates a process for cross-well profiling of formation 118. In FIG. 9, the seismic source 904 is in a separate, nearby well 902. This approach provides a method for achieving a very high resolution profile of formation 118. The seismic sensors 210 can also be used to perform non-intrusive monitoring of phenomena occurring inside a producing well (flow noises of fluid circulating inside the columns) or when production has stopped (detection of formation fractures caused by the production or injection of fluids). The seismic sensors 210 used may be hydrophones, geophones and accelerometers. The number used and their disposition are selected according to the intended applications.

Figure 11:
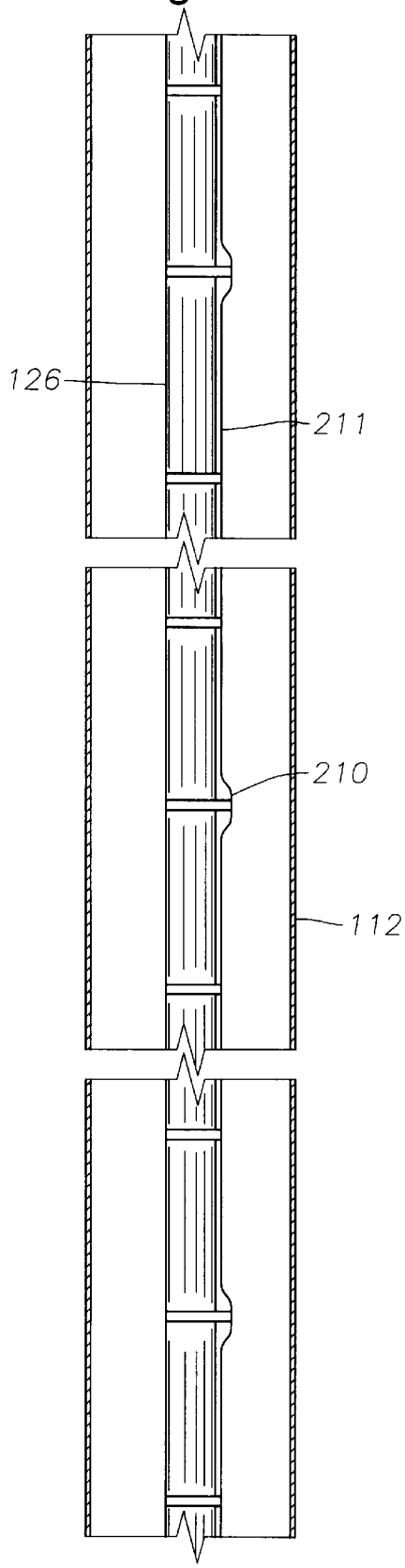
FIG. 11 shows a second embodiment of a sensor array.

Numerous variations and modifications will become apparent to those skilled in the art once the above disclosure is fully appreciated. It is intended that the following claims be interpreted to embrace all such variations and modifications. By way of example, it is recognized that the disclosed method for permanent emplacement of sensors may be used for pressure sensors, temperature sensors, as well as sensors of other kinds. Additionally, an alternate sensor array configuration such as that shown in FIG. 11 may provide for mounting the sensors 210 directly on the tubing 126.

What is claimed is:

1. An array disposed between inner and outer concentric pipes extending into a well from the surface comprising:

a plurality of spaced apart sensors configured to sense seismic waves and connected to a cable for transmitting signals to the surface;

clamps attaching said cable to the inner pipe; and biasing members attached to the inner pipe and adapted to engage said outer pipe, wherein said sensors are mounted on said biasing members adjacent the outer pipe.

2. The array of claim 1, wherein the sensors each have a sensor weight, and wherein said biasing members exert a clamping force greater than the sensor weight.

3. The array of claim 1, wherein the cable includes:

an inner umbilical attached to the sensors; and a metal coil wrapped around said inner umbilical.

4. The array of claim 3, wherein the metal coil comprises a metal wire with abutting adjacent windings.

5. The array of claim 3, wherein the metal coil comprises a metal wire with a rectangular cross-section.

6. The array of claim 3, wherein the cable further includes a wireline-wrap layer.

7. The array of claim 3, wherein the cable further includes a woven wire braid layer.

8. The array of claim 1, wherein the biasing members each include azimuthally spaced bowsprings which exert a force on the outer pipe, and wherein the sensors are each mounted on a bowspring of a corresponding biasing member.

9. The array of claim 1, wherein the biasing members each include one or more bladders which are configurable to exert a force on the outer pipe, and wherein the sensors are each mounted on a bladder of a corresponding biasing member.

10. The array of claim 1, wherein the biasing members each include a spring-mounted slider configured to exert a force on the outer pipe, and wherein the sensors are each mounted on a slider of a corresponding biasing member.

11. The array of claim 1, wherein the sensors are accelerometers.

12. A method for long term monitoring of a reservoir, wherein the method comprises:

running tubing inside a well casing;

attaching biasing elements to the tubing during the step of running tubing inside the well casing;

mounting each sensor in a sensor array on a component of the biasing element, wherein the component is configurable to contact the well casing with a force greater than the weight of the sensor; and attaching a cable which connects the sensors to the tubing.

13. The method of claim 12, wherein the biasing elements each include one or more bladders which are configurable to exert a force on the well casing, and wherein method further comprises:

inflating the bladders.

14. The method of claim 12, wherein the cable includes an inner umbilical attached to the sensors and a metal coil wrapped around said inner umbilical.

15. The method of claim 14, wherein the metal coil comprises a metal wire with abutting adjacent windings.

16. The method of claim 14, wherein the metal coil comprises a metal wire with a rectangular cross-section.

17. The method of claim 12, wherein the biasing elements each include one or more bowsprings configured to exert a force on the well casing, and wherein the sensors are each mounted on a bowspring of a corresponding biasing element.

18. The method of claim 12, wherein the biasing elements each include a spring-mounted slider configured to exert a force on the well casing, and wherein the sensors are each mounted on a slider of a corresponding biasing element.

19. The method of claim 12, wherein the method further comprises:

supplying power to the sensors via the cable; and receiving measurements from the sensors via the cable.

20. The method of claim 19, further comprising:

processing the measurements to determine event locations; and creating a log of events.

21. An array disposed between inner and outer concentric pipes extending into a well from the surface comprising:

a cable;

a plurality of spaced apart sensors connected to the cable for transmitting signals to the surface, wherein said sensors are mounted on an outer surface of the inner pipe;

clamps attaching said sensors and cable to the inner pipe, wherein the cable includes:

an inner umbilical attached to the sensors; and a metal coil wrapped around said inner umbilical.

22. The array of claim 21, wherein the metal coil comprises a single metal wire with abutting adjacent windings.

23. The array of claim 21, wherein the metal coil comprises a metal wire with a rectangular cross-section.

24. The array of claim 21, wherein the cable further includes a woven wire braid layer.

25. The array of claim 21, wherein the sensors are of a type from a set comprising: pressure sensors, temperature sensors, and seismic sensors.

* * * * *